United States Patent [19]

McPhee

[11] 3,938,519

[45] Feb. 17, 1976

[54] MEDICAL LIQUID CONTAINER WITH A TOGGLE FILM LEAK TESTER AND METHOD OF LEAK TESTING WITH SAME

[75] Inventor: Charles J. McPhee, Sylmar, Calif.

[73] Assignee: American Hospital Supply Corporation, Evanston, Ill.

[22] Filed: Feb. 26, 1974

[21] Appl. No.: 445,849

[52] U.S. Cl. ..... 128/273; 73/52; 73/49.3

[51] Int. Cl.[2] ..... A61J 1/00

[58] Field of Search..... 128/272, DIG. 24, 214 D; 215/7, 200, 230, 232, 249, 251, 270; 73/52, 49.2, 49.3; 53/53; 206/459, 365, DIG. 11; 116/114 R, 114 C, 70; 220/DIG. 16

[56] References Cited

UNITED STATES PATENTS

| | | | |
|---|---|---|---|
| 1,825,699 | 10/1931 | Landrum | 73/49.3 |
| 2,040,798 | 5/1936 | Schoonmaker | 215/7 X |
| 2,296,848 | 9/1942 | Gueffroy | 116/114 C |
| 2,383,936 | 9/1945 | Hohl | 73/49.3 |
| 2,856,929 | 10/1958 | Gossett et al. | 128/272 |
| 2,969,158 | 1/1961 | Bauman | 128/272 X |
| 3,030,955 | 4/1962 | Gossett et al. | 128/272 |
| 3,047,178 | 7/1962 | Poitras et al. | 215/249 X |
| 3,736,899 | 6/1973 | Manske | 116/70 |
| 3,774,602 | 11/1973 | Edwards | 128/194 |

*Primary Examiner*—Aldrich F. Medbery

*Attorney, Agent, or Firm*—Larry N. Barger; Robert T. Merrick

[57] ABSTRACT

A parenteral liquid bottle with a sealed leak testing chamber in its closure. This leak testing chamber has an opening sealed off by a protective thermoplastic-metal film with a permanently stretched section extending across the opening. This permanently stretched section of the film maintains either a "concave" or a "convex" shape without a pressure differential across the film. A vacuum source temporarily applied to an external surface of the film causes the film to "toggle" from its concave to its convex position indicating the chamber is properly sealed. Failure to so toggle indicates a leak in the chamber.

13 Claims, 8 Drawing Figures

MEDICAL LIQUID CONTAINER WITH A TOGGLE FILM LEAK TESTER AND METHOD OF LEAK TESTING WITH SAME

BACKGROUND

Sterile medical liquid, such as parenteral solution, is commonly infused into a patient's vein from a container hanging above the patient. The sterile liquid flows by gravity through a tubular administration set connected at one end to the container and at an opposite end to a venous needle in the patient.

These sterile parenteral solutions, such as 5% dextrose, normal saline, etc. are frequently supplied to the hospital in sterilized containers. When these bottles are of the rigid glass type, a vacuum within the bottle can be used to test the hermetic seal at the bottle closure. One such testing device is a thin, latex disk fitting over an opening in a rubber stopper of an evacuated glass bottle. As long as the bottle holds the vacuum, the disk will show a visual deformation into the stopper opening. A leak in the bottle causes a vacuum loss and the latex disk resumes its undeformed shape.

Recently, thermoplastic bags and bottles have been proposed for intravenous solutions because of improved handling characteristics, reduced freight costs, easier disposal, etc. Such thermoplastic containers are not sufficiently rigid to continuously maintain a vacuum. Thus, a permanent vacuum within the bottle cannot be used as a leak test.

In parenteral solution bottles, it has also been proposed to provide an evacuated chamber between two metal caps fitted to a neck of a bottle. The vacuum within the chamber holds a top of an outer cap in a depressed state. If the vacuum is lost, the top of the outer cap will deflect outwardly indicating a leak. Such a preformed, 3-dimensional cap structure is expensive to manufacture. It is also difficult to precisely control the springiness of the top wall of the outer cap so that it will work properly.

SUMMARY OF THE INVENTION

The present invention overcomes the problem of previous leak testing structures that required a permanent vacuum to be maintained. In this invention, a sealed test chamber is formed in a closure system of a thermoplastic bottle. This sealed chamber includes a rigid tube, a puncturable diaphragm sealing an inner end of the tube and segregating the bottle's interior from the test chamber, and a deformaable film hermetically sealing an outer end of the tube. The chamber within the tube between the film and puncturable diaphragm does not require a vacuum to be maintained in this chamber when the chamber functions as a leak tester.

A flat film, which is a metal-thermoplastic laminate, is sealed to an outer end of the tube. The film is then permanently deformed into a concave shape that is maintained without a pressure differential across the film. A temporarily applied vacuum source to an outer furface of the film causes the concave film to "toggle" into a convex shape. This convex shape is maintained after the vacuum source is temporarily applied, this indicates the chamber is properly sealed. If the film does not toggle this indicates a leak in the chamber and the entire plastic bottle and closure system should be discarded.

The deformed film leak tester is very easy to manufacture because the film is assembled in a flat condition. There is no requirement for orienting or aligning a concave shape with an opening in a bottle closure. Also, the concave shape is precisely dimensioned to the rigid tube because it is concavely formed against the tube after the film has been sealed to the tube. Once the film has been so deformed on the tube, it will maintain either a "concave" or a "convex" configuration without requiring a vacuum in either the test chamber or in the liquid containing bottle. The puncturable diaphragm seals an interior of the bottle from the test chamber and prevents pressure changes in the bottle, such as when the bottle is squeezed, from exerting a similar pressure change on the deformed film.

THE DRAWINGS

DETAILED DESCRIPTION

Figure 1:
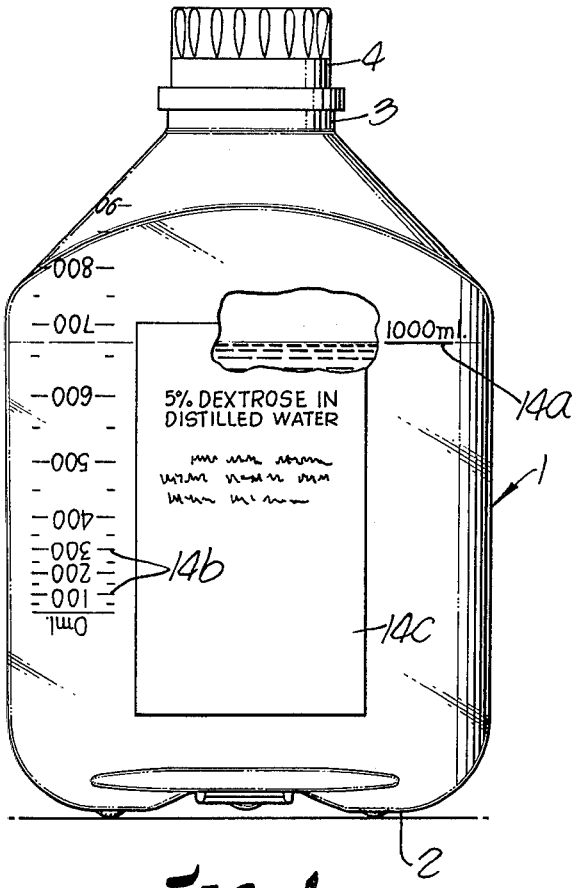
FIG. 1 is a front elevational view of the sterile medical liquid bottle as it is supplied by the manufacturer to the hospital.

Referring to these drawings, FIG. 1 shows a laterally collapsable thermoplastic bottle 1 as it is supplied by the manufacturer to the hospital. The laterally collapsable thermoplastic bottle 1 has a relatively rigid base 2 and a relatively rigid dispensing neck structure 3 that is connected to a relatively rigid shoulder of the bottle. The bottle has a tubular side wall with sufficient columnar rigidity to support the bottle upright as in FIG. 1, but will laterally deflect inwardly as liquid is dispensed through the bottle neck without the concurrent entry of air into the bottle. Fitting on this neck 3 is an outer cap 4. On a front of the bottle is a calibration **14*a* indicating a fill mark. There is also calibration 14*b* to show how much liquid has been dispensed to a patient. Between these calibrations is a label 14*c***.

Figure 2:
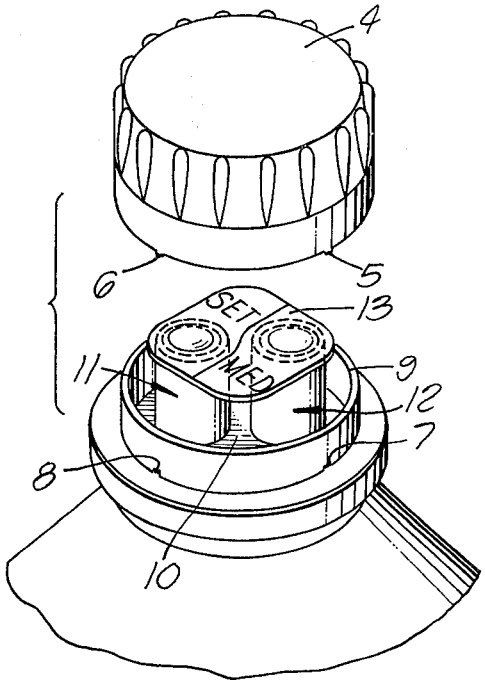
FIG. 2 is an enlarged perspective view of the top portion of the bottle showing the outer cap removed.

In FIG. 2, the outer cap 4 has been ruptured at frangible sections such as 5 and 6, and the outer cap removed to expose an inner closure. These frangible sections, 5 and 6, were connected respectively at 7 and 8 on the bottle neck. The outer closure is explained in more detail in my copending application entitled "Three Barrier Closure System for Medical Liquid Container," Ser. No. 445,834. Alternatively, this outer cap could be a frangible cap as explained in a copending application entitled "Frangible Closure System for Medical Liquid Container and Method of Making Same," Ser. No. 338,685, invented by Pradip Choksi.

The inner closure system of FIG. 2 includes an upstanding collar 9 and a transverse wall 10. Connected to transverse wall 10 and integrally formed therewith are two upstanding rigid tubes, 11 and 12, which respectively define an outlet passage and an inlet passage. Sealed to the outer ends of tubes 11 and 12, which terminate in a common transverse plane, is a film 13. Preferably film 13 is severed to form two sections so that a film section can be independently peeled back from either tube without disturbing the film's seal on the other tube. In FIG. 2, the term "SET" indicates the tube that is for attachment to an administration set. The term "MED" indicates a tube for additive medication injection.

Figure 3:
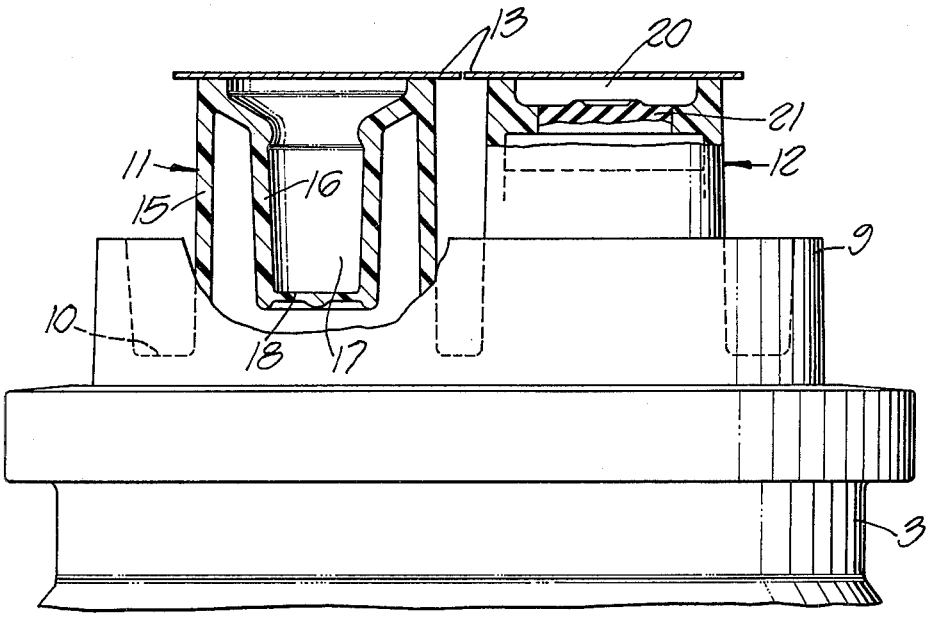
FIG. 3 is a further enlarged view, partially in section, of the closure structure with the outer cap removed.

The structure of rigid tubes 11 and 12 and their relationship to film 13 is shown in more detail in FIG. 3. Here the outlet tube shown generally as 11 includes an exterior support tube 15 and an interior tube 16. It is interior tube 16 that has a passage defining chamber 17. The interior tube 16 is hermetically closed at its lower end by a puncturable diaphragm 18 and is hermetically sealed at its upper end by film 13. The outlet tube structure including interior tube 16 is adapted to connect to an administration set for dispensing the liquid contents of the bottle. The interior tube 16 has an annular rib extending below the diaphragm to prevent premature fracture of the diaphragm before an administration set is attached. This rib strengthens the juncture between diaphragm 18 and tube 16.

Sometimes it is desirable to add medication to the parenteral solution bottle. This is done through the rigid inlet tube 12 shown at the right portion of FIG. 3. This rigid inlet tube 12 has an internal chamber 20. This internal chamber is defined by film 13 sealed across an outer end of tube 12 and a puncturable resealable rubber diaphragm 21 spaced from and located below the film 13. When additive medication is to be added to the container, film 13 is peeled back from rigid inlet tube 12. A hypodermic syringe or additive container is used to puncture diaphragm 21 and inject the additive medication.

It is important to know that both of these rigid tube structures 11 and 12 are similar in that they both define chambers shown respectively at 17 and 20. both have sections of film 13 closing off upper end portions of the tubes. A transverse diaphragm closes off the respective tubes 11 and 12 at a distance spaced below film 13. These diaphragms are respectively 18 and 21. For purposes of the deformable leak film indicator, both rigid tube structures 11 and 12 with their respective chambers 17 and 20 operate essentially the same. This is true even though chamber 17 is substantially larger than chamber 20.

Figure 4:
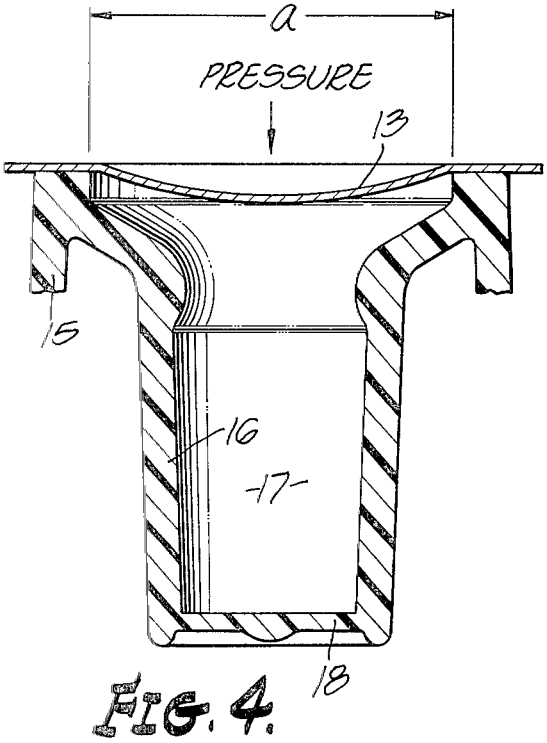
FIG. 4 is a still further enlarged sectional view of the chamber showing the film deformed into a concave shape.

For purposes of explanation, the operation of the deformable film leak indicator will be described with reference to rigid tube 11 and particularly its interior tube 16. In FIG. 4, interior tube 16 has a transverse puncturable thermoplastic diaphragm 18 that is not resealable after the puncture. The film 13 which closes off the upper end portion of interior tube 16 is orginally hermetically sealed to the two rigid tubes with the film in a flat condition as shown in FIG. 3. When initially applied, the film 13 has neither a concave nor a convex configuration. Thus, there is no requirement for orientation and alignment of a particular section of the film.

After film 13 has been sealed to the two rigid tubes as shown in FIG. 3, it is first covered by a vented cap (not shown) and then deformed into the concave shape as shown in FIG. 4. This is done by placing the unit in a steam sterilizer with an over-riding pressure from 30 psig to 40 psig (2.1 to 2.8 Kg/cm$^2$, gauge) at 240° to 260°F (116° to 127°C). The film 13 in FIG. 4 spans an opening as shown by dimension *a* in FIG. 4. Preferably the upper end of interior tube 16 has a circular opening of from .300 inch to .500 inch (7.5mm to 12.5mm). The film preferably is a metal-thermoplastic laminate having a thickness from .002 inch to .008 inch (.050mm to .200mm). The ratio of the opening diameter of interior tube 16 to the film thickness preferably is in the range from 35 to 250. As the over pressure is applied in FIG. 4 during steam sterilization, the film 13 permanently deforms to a concave configuration as shown. This concave shape will be maintained by film 13 after the pressure has been relieved. Thus, the concave configuration of the film can be maintained with equal pressure (i.e. atmospheric) on both the upper surface and the lower surface of film 13 after the bottle has been sterilized and returned to room temperature. Although the concave deformation of the film 13 in FIG. 4 may very slightly decrease the volume of chamber 17, this is considered to have an insignificant effect on changing the pressure in chamber 17 from atmospheric after the bottle has returned to room temperature.

Figure 5:
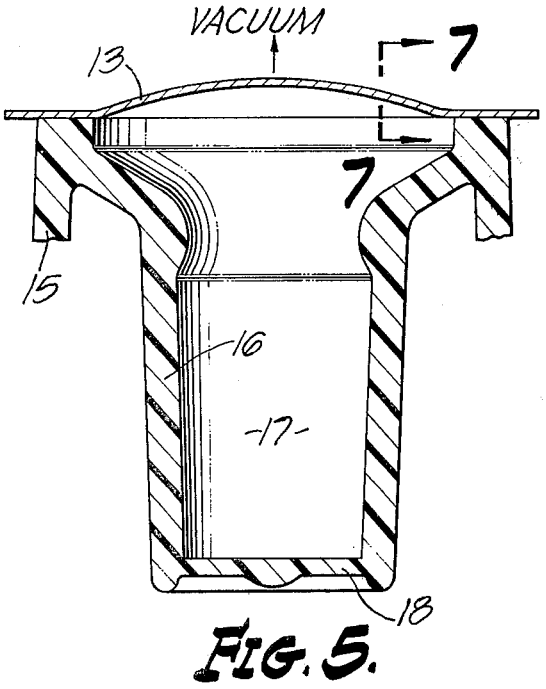
FIG. 5 is a sectional view similar to FIG. 4, but showing the film after it has been toggled into a convex shape.
Figure 8:
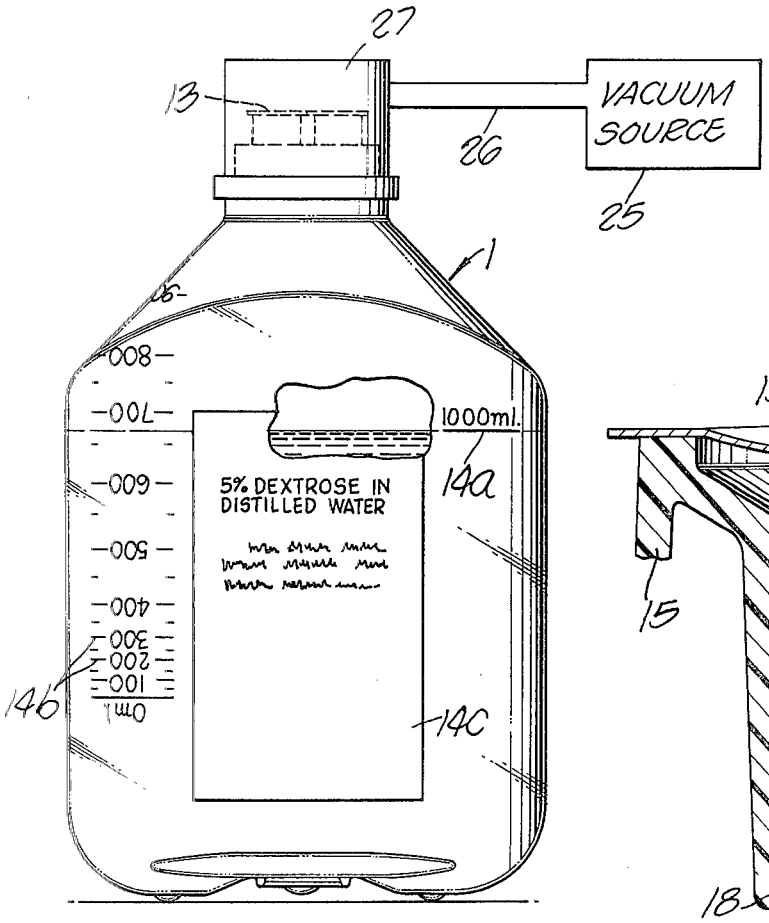
FIG. 8 is a front elevational view of the bottle during the procedure for leak testing.

After the bottle has been filled with parenteral solution and sterilized and the film 13 deformed into a concave configuration, the temporary vented cap (not shown) is removed and a leak test of chamber 17 is performed. This is done by subjecting the external surface of film 13 to a vacuum source 25 for a period of 1 to 5 seconds, as shown in FIG. 8. This vacuum source 25 is connected to a vacuum hood 27 by a vacuum line 26. As vacuum is pulled on the upper surface of film 13, the pressure on this upper surface is reduced from atmospheric, 14 to 15 psia (.98 to 1.05 Kg/cm$^2$, absolute), to a pressure on the external surface of between 1 and 3 psia (.07 to .21 Kg/cm$^2$, absolute). The air in chamber 17 is at atmospheric pressure and will push film 13 outwardly and "toggle" the film into a convex shape as shown in FIG. 5. After the vacuum has been relieved, film 13 will maintain its convex configuration to get a visual indication that the vacuum test has been performed and chamber 17 passed this leak test. After the leak test, outer cap 4 is fused to the bottle. Preferably this outer cap is sufficiently transparent for visually observing the dome shape of the film through the cap.

Figure 6:
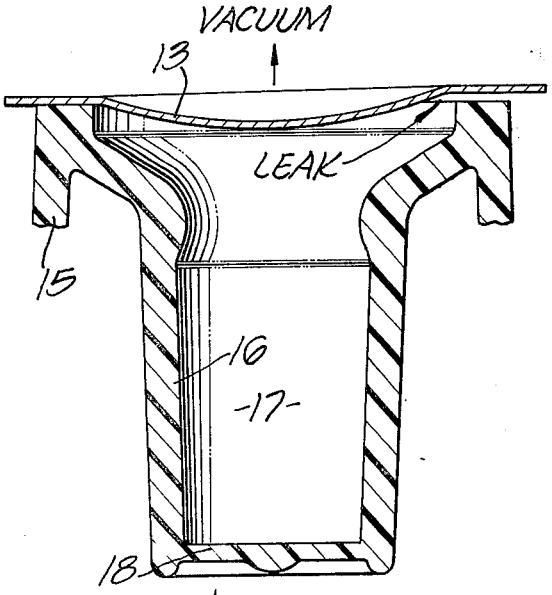
FIG. 6 is a view similar to FIG. 5, but showing the concave nature of the deformed film during a leak test when the chamber has a leak.

FIG. 6 shows that film 13 will not toggle from its "concave" position to its "convex" position if there is a leak in chamber 17 when the vacuum is pulled on the film's exterior surface. Film 13 will not toggle because the vacuum which creates a pressure of approximately 1 to 3 psia (.07 to .21 Kg/cm$^2$, absolute) on the film's exterior surface will exert this same pressure on the under side of film 13 through the leak passage. Thus, if the chamber 17 is vacuum tested as shown in FIG. 8 and the film 13 remains in a concave position, there is a leak in chamber 17 and the bottle should be discarded.

Figure 7:
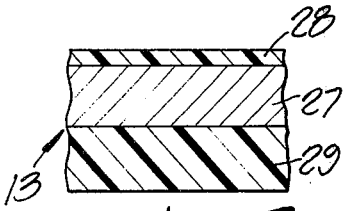
FIG. 7 is a sectional view taken along lines 7—7 of FIG. 5.

It is important for the "toggling" action of film 13 that the film have a sufficient stiffness to maintain the film in either the concave or the convex position without a pressure differential across the film. A film that is too thin and stretches too greatly will not structurally support the convex dome as shown in FIG. 5. A film that is not stretched enough will not visibly show a significant difference between a concave and convex position. A film that works very well for this particular purpose is a three-part film. As shown in the sectional view of FIG. 7, this three-part laminated film has an aluminum center layer 27, an outer thermoplastic polyester layer 28 and an inner thermoplastic high density polyethylene layer 29. The polyethylene layer 29 seals against the outer surfaces of rigid tube 11 and 12. Preferably the aluminum and polyethylene layers are each substantially thicker than the polyester layer 28. An example of a suitable combination is where the aluminum and polyethylene layers are each .002 inch (.050mm) thick and the polyester layer is .0005 inch (.012mm) thick. This makes a combined thickness of the three-layer laminate of .0045 inch (.112mm). The combined thickness of the laminated film 13 could be in the range from .002 inch to .008 inch (.050mm to .200mm).

Although the description of the leak test has been described relative to chamber 17 in the outlet tube structure, the same leak test is simultaneously performed on the inlet tube structure 12.

It has been found that the above invention works very well when the bottle and closure with its rigid tube structures are formed of a propylene-ethylene copolymer thermoplastic.

In the foregoing specification and attached drawings, a specific example has been used to illustrate the invention. However, it is understood that persons skilled in the art can make certain modifications to this example without departing from the spirit and scope of the invention.

I claim:

1. A medical liquid container with a puncturable tubular connector for joining the container to a fluid transferring device, wherein the improvement comprises:

a combined connector and toggle leak tester that includes an upstanding thermoplastic tube with a passage and an outer end surface; a first thermoplastic barrier integrally formed with the tube and sealing off the tube's passage at a location spaced inwardly from the tube's outer end surface; a flexible film bonded at a manually peelable joint to the tube's outer end surface and forming a second barrier, said film being in a deformed state with one convex surface and one concave surface for toggling when a pressure differential is applied across the film, whereby the film can function as a leak tester and also be isolated from contact with the container's contents.

2. The combination as set forth in claim 1, wherein the second barrier film toggles from a concave position to a convex position when its inner surface is subjected to atmospheric pressure of approximately 14 to 15 psia (.98 to 1.05 Kg/cm$^2$, absolute), and its outer surface is subjected to a temporary vacuum reducing the pressure on the outer surface to 1 to 3 psia (.07 to .21 Kg/cm$^2$, absolute).

3. The combination as set forth in claim 1, wherein the film is a metal-thermoplastic laminate.

4. The combination as set forth in claim 3, wherein the film is a laminated sandwich of two thermoplastic layers having a metallic film laminated therebetween.

5. The combination as set forth in claim 4, wherein the metallic film is aluminum, the thermoplastic layer forming the outer surface is a polyester thermoplastic, and the thermoplastic layer forming the inner surface is a high-density polyethylene thermoplastic.

6. The combination as set forth in claim 4, wherein the rigid tube has an outer end and the passage through the tube has a diameter of .300 inch to .500 inch (7.5 to 12.5mm) and the film is bonded to the outer end of the rigid tube.

7. The combination as set forth in claim 6, wherein the film has a thickness of from .002 inch to .008 inch (.050mm to .200mm).

8. The combination as set forth in claim 1, wherein the deformed area of the film is generally circular and has a diameter to thickness ratio of 35 to 250.

9. The combination as set forth in claim 1, wherein the container has an inlet tube thereon with a puncturable resealable diaphragm forming said first barrier.

10. The combination as set forth in claim 1, wherein the container includes a removable outer cap sealed to the container and encasing the film and rigid tube structures.

11. The combination as set forth in claim 10, wherein the outer cap is sufficiently transparent for visually observing the convex film through the cap.

12. The combination as set forth in claim 1, wherein there is an additional rigid tube connected to the container and this additional tube has a passage into an interior of the container; a first barrier hermetically sealing off the passage of the additional tube from an interior of the container; a flexible deformed film having an inner surface and an outer surface and providing a second barrier that seals off the passage of the additional tube at a location spaced outwardly from the first barrier so as to define a sealed chamber between the two barrier; said second barrier film on the additional tube having one surface concave and the other surface convex; and said second barrier film on the additional tube having a structure that can toggle between a generally concave position to a generally convex position in response to a temporary pressure differential applied across the film, thereby performing a leak test without the necessity of any significant vacuum maintained in either the sealed chamber of the additional tube or the interior of the container.

13. In a thermoplastic medical liquid container having a tubular neck, the improvement of: a closure hermetically sealed across the container neck and having a rigid upstanding thermoplastic outlet tube with a dispensing passage therethrough; said outlet tube being sealed off by a first puncturable thermoplastic diaphragm integrally formed with the outlet tube; a rigid upstanding thermoplastic inlet tube connected to the closure and having an inlet passage therethrough; a puncturable resealable rubber diaphragm within the inlet tube and sealing off its passage; said outlet tube and inlet tube having outer ends terminating in a common plane; a three-layer thermoplastic-metal-thermoplastic laminate sandwich forming a film with inner and outer surfaces and one of the thermoplastic layers is hermetically sealed at a manually peelable joint to the outer ends of the thermoplastic outlet and inlet tubes; said deformable film having a visible concavoconvex deformation across the passage of each tube, said deformed film having a diameter to thickness ratio at each tube passage of from 35 to 250 and is capable of maintaining a visible concave or a convex configuration with equal pressure on inner and outer surfaces of the film, said film toggling from a concave configuration to a convex configuration when a temporary vacuum is appled to its outer surface; and a removable outer cap fitting over and enclosing the film and tube structure.

* * * * *